US010486850B1

(12) United States Patent
Cook et al.

(10) Patent No.: US 10,486,850 B1
(45) Date of Patent: Nov. 26, 2019

(54) HINGED CLICK TO CLOSE CONTAINER

(71) Applicant: The Procter & Gamble Company, Cincinnati, OH (US)

(72) Inventors: Grace Catherine Cook, Cincinnati, OH (US); Kassandra Walburger, Cincinnati, OH (US); Gary Joseph Foose, Ft. Thomas, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/977,509

(22) Filed: May 11, 2018

(51) Int. Cl.
*B65D 5/10* (2006.01)
*B65D 5/66* (2006.01)
*B65D 5/54* (2006.01)
*B65D 43/16* (2006.01)

(52) U.S. Cl.
CPC ..... *B65D 5/6623* (2013.01); *B65D 5/541* (2013.01); *B65D 5/6608* (2013.01); *B65D 43/162* (2013.01)

(58) Field of Classification Search
CPC .... B65D 5/6623; B65D 5/541; B65D 5/6608; B65D 43/162; B65D 5/66; B65D 5/665; A47K 2010/3266; A47K 10/421
USPC ..... 229/229, 234, 223, 131, 232, 149, 247, 229/125.29, 125.32; 220/254.1, 254.3, 220/259.1, 315; 222/556
See application file for complete search history.

(56) References Cited

U.S. PATENT DOCUMENTS 1,361,882 A * 12/1920 List ..... B65D 5/5206 206/45.25
2,360,415 A * 10/1944 Gilbert ..... B65D 5/701 229/212
2,473,492 A 6/1949 Shina
3,310,223 A 3/1967 Buttery
4,043,503 A 8/1977 Meyers
4,746,019 A * 5/1988 Prater ..... B65D 5/5435 229/149
4,799,594 A * 1/1989 Blackman ..... B65D 5/701 229/125
4,860,886 A * 8/1989 Northrup ..... B65D 5/524 206/45.29
4,951,824 A 8/1990 Kuchenbecker
5,085,323 A 2/1992 Kuchenbecker
5,100,004 A 3/1992 Kuchenbecker
5,556,026 A * 9/1996 Blankitny ..... B65D 5/0236 229/123.1
5,911,359 A 6/1999 Stone
7,121,403 B2 * 10/2006 Bohdan ..... B65D 5/28 206/273

(Continued)

FOREIGN PATENT DOCUMENTS

JP S56164924 A 12/1981
WO WO2005000692 A1 1/2005

OTHER PUBLICATIONS

European Search Report for Application No./Patent No. 19173732.9-1016, dated Oct. 14, 2019, 6 pages.

*Primary Examiner* — Christopher R Demeree
(74) *Attorney, Agent, or Firm* — Gary J. Foose

(57) ABSTRACT

A container having a hinged opening flap having free end portion. The free end portion comes into facing relationship with a free end portion seat. One or more locking tabs connected to the opening flap or the free end portion seat edge are provided. The locking tabs can lock the opening flap into a closed position. The container can be erected from a blank.

19 Claims, 10 Drawing Sheets

(56) References Cited

U.S. PATENT DOCUMENTS

| | | | | |
|---|---|---|---|---|
| 7,699,214 | B2 * | 4/2010 | Mestre | B65D 5/606<br>206/233 |
| 8,063,345 | B2 | 11/2011 | Middleton | |
| 2005/0109827 | A1 * | 5/2005 | Martin | B65D 5/5435<br>229/232 |
| 2006/0180645 | A1 * | 8/2006 | Takagi | B65D 5/705<br>229/130 |
| 2007/0102499 | A1 * | 5/2007 | Lo Duca | B65D 5/0254<br>229/229 |

* cited by examiner

HINGED CLICK TO CLOSE CONTAINER

FIELD OF THE INVENTION

A container having a hinged opening flap that is mechanically engageable with another portion of the container when the opening flap is in a closed position.

BACKGROUND OF THE INVENTION

A variety of goods are packaged in containers having an opening flap. Opening flaps are an attractive opening feature since when opened, the opening flap remains connected to some other part of the container. Such opening flaps are desirable since the opening flap conveniently remains attached to the container when the user of the container desires to close the container.

Containers typically employ an opening flap in one of two arrangements. In the first arrangement, the opening flap is an entire planar surface of the container and the opening flap is pivotably connected to the remainder of the container body. This arrangement advantageously provides for a wide opening into the container and can make it convenient to access the contents of the container. For plastic containers, the opening flap may seal to the remainder of the container by a wedge seal between a channel about part of the periphery of the opening flap and a rim about part of the container. To open the user must apply sufficient force to dislodge the channel in the opening flap from the rim of the remainder of the container. Such wedge seals can provide for an opening flap that tightly seals to the remainder of the container. However, opening flaps having wedge seals that are too tight can be inconvenient to open. For paperboard containers, the opening flap is commonly provided with one or more flaps that are tucked into the inner periphery of the remainder of the container. Opening flaps that are tuck closed are notorious for being leaky, sometimes unpredictably pop open, and can be over-rotated and end up being pushed into the interior of the remainder of the container when heavy objects are placed on the opening flap or when the user applies too much force to the opening flap when closing the opening flap.

In the second arrangement, the opening flap is part of a planar surface of the container. When the user opens the flap, a portion or portions of the surface remain connected to the remainder of the container body. Typically, the opening flap is a partial cutout of the planar surface with the boundary between the opening flap and planar surface from which it is cut being a through cut of the planar surface made orthogonal to the planar surface of the container. This arrangement advantageously provides for an opening that can be sized and dimensioned to provide easy access to the contents of the container, can be easy to manufacture, and can be sized and dimensioned to help retain the contents of the container if the container is tipped over. Problems associated with such types of opening flaps include that they may be leaky, they may unpredictably open, and they can be over-rotated and end up pushed into the interior of the remainder of the container when heavy objects are placed on the opening flap or when the user applies too much force when closing the opening flap.

With these limitations in mind, there is a continuing unmet need for containers having an opening flap that can be securely closed and be less prone to over-rotating into the interior of the container.

SUMMARY OF THE INVENTION

A container comprising: a top panel having a top panel exterior facing surface; a hinge; an opening flap connected to said hinge; a locking tab connected to one of said opening flap and a free end portion seat having a free end portion seat edge, wherein said free end portion seat is recessed relative to said top panel exterior facing surface; and a container body engaged with said top panel, wherein said top panel, said opening flap, and said container body together define an interior space; wherein said opening flap comprises; a hinged portion having two hinged portion ends; a free end portion in facing relationship with said free end portion seat; two opening flap edges separable from said top panel, each opening flap edge extending from one of said hinged portion ends to said free end portion; and wherein said free end portion overlies said free end portion seat edge between two intersection points separated by a separation distance; and wherein for each opening flap edge, said opening flap edge is in a nonoverlapping relationship with said top panel from said intersection point to along said opening flap edge to a distance of more than about 20% of said separation distance; wherein said locking tab is closer to said hinge than said free end portion is to said hinge.

A container comprising: a top panel having a top panel interior facing surface; a free end portion seat in facing relationship with and joined to said top panel interior facing surface, wherein said free end portion seat has a free end portion seat edge; a hinge; an opening flap connected to said hinge; a locking tab integral with one of said opening flap and said free end portion seat edge; a container body engaged with said top panel, wherein said top panel, said opening flap, and said container body together define an interior space, wherein said container body, said free end portion seat, said locking tab, said top panel, and said opening flap are a one-piece paperboard; wherein said opening flap comprises; a hinged portion having two hinged portion ends; a free end portion in facing relationship with said free end portion seat; wherein said free end portion overlies said free end portion seat edge between two intersection points separated by a separation distance; and two opening flap edges at least partially defined by reverse cuts extending from proximal said hinged portion ends towards said locking tabs, wherein at a distance from said locking tabs of more than about 20% of said separation distance said reverse cuts merge; wherein said locking tab is closer to said hinge than said free end portion is to said hinge.

A carton blank comprising: a free end portion seat having a free end portion seat edge; a front panel extending from and integral with said free end portion seat across a first fold line, said free end portion seat between said first fold line and said free end portion seat edge; a bottom panel extending from and integral with said front panel across a second fold line; a rear panel extending from and integral with said bottom panel across a third fold line; a top panel extending from and integral with said rear panel across a fourth fold line; an opening flap connected to said top panel or said rear panel by a hinge; wherein said opening flap comprises: a hinged portion having two hinged portion ends; two opening flap edges at least partially defined by reverse cuts extending from proximal said hinged portion ends towards a free end portion opposing said hinged portion, wherein each opening flap edge has an opening flap edge length along said opening flap edge between said hinged portion end to said free end portion, wherein said reverse cuts merge at a location more than about 10% of said opening flap edge length away from said free end portion; and one or more locking tabs at a location selected from the group consisting of extending from and integral with the opening flap edge, extending from and integral with the free end portion seat edge, and in the opening flap nearer to said free end portion than a distance orthogonal to said first fold line and between said first fold line and said free end portion seat edge.

DETAILED DESCRIPTION OF THE INVENTION

Containers of the type disclosed herein can be convenient for packaging and storing goods including food products, confectionaries, powder laundry detergent, fabric softening sheets, toys, paper goods, diapers, feminine care products, articles comprising perfume, facial tissue, soluble unit dose pouches, doughnuts, pastries, cakes, cookies, and the like.

Figure 1:
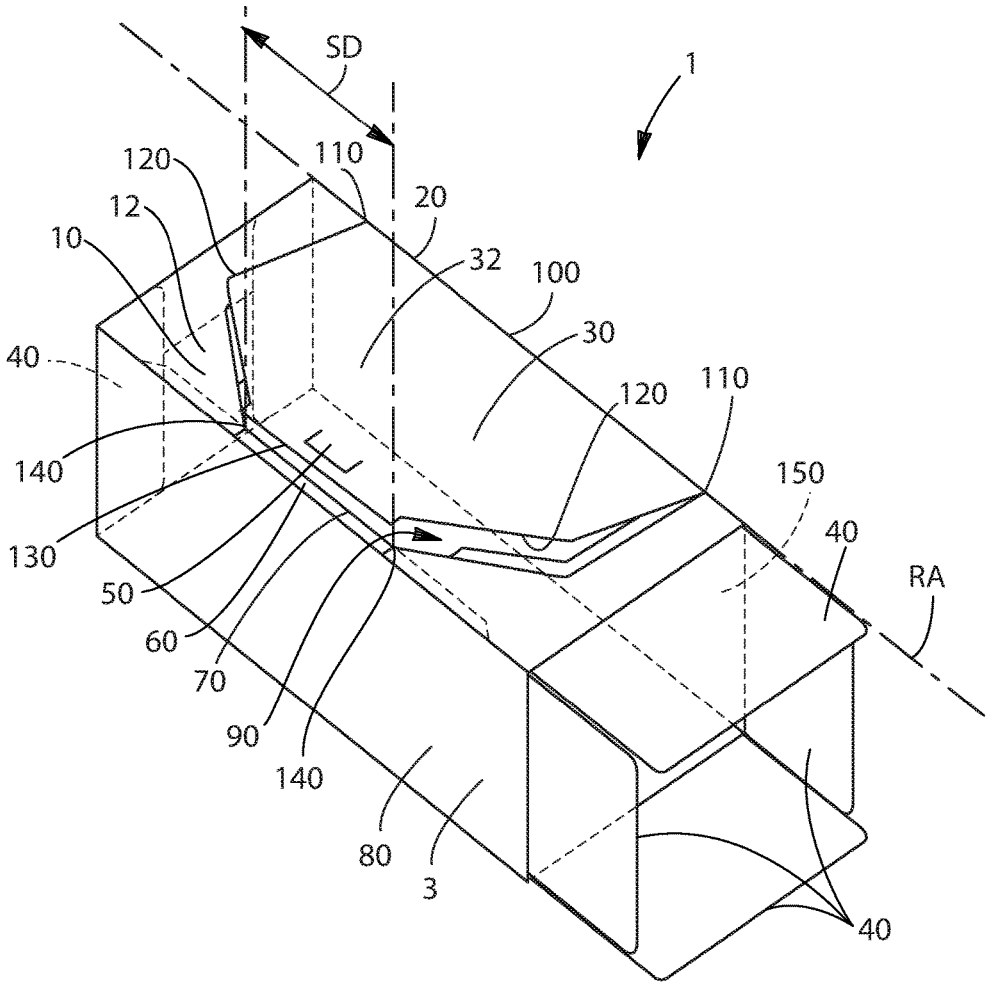
FIG. 1 is a container constructed from a one-piece paperboard, then flaps at one end of the container illustrated in an unfolded open position.

A container 1 is shown in FIG. 1. The container 1 can comprise a top panel 10 and a hinge 20. The container 1 can further comprise an opening flap 30 connected to the hinge 20. The container 1 can be a one-piece paperboard 3. Optionally, the container 1 can be a plastic tub to which a plastic top panel 10 is attached. In the arrangement shown in FIG. 1, the container 1 comprises a plurality of flaps 40 suitable for closing the ends of the container 1. The flaps 40 at one end of the container 1 are illustrated in an open position.

To provide for securely closing the opening flap 30, the container 1 can comprise a locking tab 50. The locking tab 50 can be connected to one of the opening flap 30 and the free end portion seat 60, the free end portion seat 60 having a free end portion seat edge 70. The locking tab 50 or tabs 50 can be connected to or integral with one of the opening flap 30 and the free end portion seat edge 70. When the opening flap 30 is moved from an open position to a closed position, the locking tab 50 can interfere with movement of the opening flap. Force applied by the user of the container 1 can deform one or both of the locking tabs 50 or an edge with which the locking tab 50 or tabs 50 are attached or an edge with which the locking tab 50 passes enough so that the locking tab 50 can move past the edge with which the locking tab 50 is engaged when the opening flap 30 is in a closed condition. The movement of the locking tab 50 and or edge with which the locking tab 50 is attached or engaged past one another can produce an audible click sound. The locking tab 50 or locking tabs 50 can have from about 0.1 mm to about 3 mm, optionally from about 0.2 mm to about 2 mm, optionally about 0.3 mm to about 1 mm of interference with the structure with which it or they interfere.

The container 1 can comprise a container body 80 engaged with the top panel 10. The top panel 10, opening flap 30, and container body 80 can together define an interior space 90. The top panel 10 can have a top panel interior facing surface oriented towards the interior space 90 and an opposing top panel exterior facing surface 12. Similarly, the opening flap 30 can have an opening flap interior facing surface oriented towards the interior space 90 and an opposing opening flap exterior facing surface 32.

The opening flap 30 can comprise a hinged portion 100 having two hinged portion ends 110. The opening flap 30 can comprise two opening flap edges 120 that are separable from or separated from the top panel 10. Each opening flap edge 120 can extend from one of the hinged portion ends 110 to a free end portion 130. The free end portion 130 can be the distal end of the opening flap 30. The free end portion 130 can be in facing relationship with the free end portion seat 60 when the opening flap 30 is in the closed position or before the opening flap 30 is first opened. The locking tab 50 or locking tabs 50 can be nearer to the hinge 20 than the free end portion 130. The free end portion seat 60 can be recessed relative to the top panel 10. The free end portion seat 60 can be recessed relative to the top panel exterior facing surface. Such an arrangement can allow the top panel exterior facing surface 12 of the top panel 10 and the opening flap exterior facing surface 32 of the opening flap 30 to be flush with one another or substantially flush with one another. The top panel 10 and the free end portion seat 60 can lie in planes parallel or generally parallel to one another. The free end portion seat 60 can be recessed relative to the top panel exterior facing surface 12. So, the free end portion seat 60 can lie in a different plane than the top panel exterior facing surface 12. Such positioning of the free end portion seat 60 can be provided during fabrication of the top panel 10 and the opening flap 30. The free end portion seat 60 can be an extension of the front panel folded underneath the top panel 10 and free end portion 130 and the free end portion seat edge 70 can be oriented towards the hinged portion 100. The free end portion seat 60 can be substantially parallel or parallel to the top panel 10. The free end portion seat 60 can be in partial facing relationship with the top panel 10. To provide for mechanical stability of the container 1 when a one-piece paperboard 3 is employed, the free end portion seat 60 can be in facing relationship with and joined to the top panel interior facing surface, for instance by a glue or interlocking tab and slot features or the like. The flaps 40 may be folded inwardly and one or more of the flaps 40 may be glued to one or more flaps 40 to provide closed ends of the container 1.

The free end portion 130 can have from about 1 $cm^2$ to about 20 $cm^2$, optionally from about 1 $cm^2$ to about 10 $cm^2$, optionally from about 1 $cm^2$ to about 5 $cm^2$, of the surface thereof in facing relationship with the free end portion seat 60. Such quantity of the free end portion 130 in facing relationship with the free end portion seat 60 can provide for adequate bearing area to support the opening flap 30 when the opening flap 30 is pushed to click the locking tab 50 or locking tabs 30 into a locked position.

For a locking tab 50 or locking tabs 50 connected to the free end portion seat 60, the locking tab 50 or locking tabs 50 are beneath a plane defined by the opening flap 30 when the locking tab 50 or locking tabs 50 are disengaged with the opening flap 30. That is, the locking tab 50 or locking tabs 50 are beneath a plane defined by the opening flap 30 when the locking tab 50 or locking tabs 50 are disengaged with the opening flap 30. Another way of describing the position of the locking tab 50 or locking tabs 50 if they are connected to the free end portion seat 60 is that the locking tab 50 or locking tabs 50 are in plane with the free end portion seat 60.

For a locking tab 50 or locking tabs 50 connected to opening flap 30, the locking tab 50 or locking tabs 50 can be above a plane defined by the free end portion seat 60 when the locking tab 50 or locking tabs 50 are disengaged with the free end portion seat edge 70. That is, the locking tab 50 or locking tabs 50 are above a plane defined by the free end portion seat 60. Another way of describing the position of the locking tab 50 if it is connected to the opening flap 30 is that the locking tab 50 or locking tabs 50 are in plane with the opening flap 30.

The hinge 20 can be a fold line between the material constituting the opening flap 30 and the top panel 10. The hinge 20 can be a fold line between the material constituting the opening flap 30 and the rear panel 150. The hinge 20 can coincide with the fold line between the top panel 10 and the rear panel 150. The hinged portion 100 comprises the entirety of the portion of the opening flap 30 that moves pivotably about the hinge. The hinged portion 100 may comprise a hinge 20. Of course, the entirety of the hinged portion 100 can be a hinge 20. The hinged portion 100 may comprise two or more spaced apart hinges 20. The opening flap 30 can pivot about the one or more hinges 20.

The free end portion 130 can overlie the free end portion seat edge 70 between two intersection points 140 that are separated by a separation distance SD. For each opening flap edge 120, the opening flap edge can be in a nonoverlapping relationship with the top panel 10 from the intersection point 140 to along the opening flap edge 120 to a distance of more than about 20% of the separation distance SD. Optionally, the opening flap edge 120 can be in a nonoverlapping relationship with the top panel 10 from the intersection point 140 to along the opening flap edge 120 to a distance of more than about 20% of the separation distance SD up to a total of an entirety of the opening flap edge 120 being in non-overlapping relationship with the top panel 10.

The container 1 can be conveniently provided as a one-piece paperboard carton and be in a closed condition in which the opening flap 30 or portions of the opening flap are integral with the top panel 10. When the consumer desires to open the container 1, the consumer can lift the free end portion 130 and apply force to controllably separate the opening flap edges 120 or portions thereof from the top panel 10.

The container 1 can also be conveniently provided as a plastic tub having a top panel 10. The top panel 10 and opening flap 30 can be a one-piece plastic part. The top panel 10 can be connected to the container body 80, for instance by a wedge seal connecting the container body 80 to the top panel 10, and thereby the opening flap 30 as well. Optionally the top panel 10 can be connected to the container body 80 by some other mechanical fastening, by way of nonlimiting example by a threaded fastener between top panel 10 and container body 80, rivets, screws, nuts and bolts, interlocking tabs, and the like. Optionally, the top panel 10 can be connected to the container body 80 by an adhesive bond or weld. The top panel 10 and opening flap 30 can be molded so that the opening flap edges 120 are discontinuous with the top panel 10. Optionally, the top panel 10 and the opening flap edges 120 can be molded so that the two elements are integral with one another or connected to one another in some manner across the boundary between the two elements and the two elements can be separated from one another upon first opening the opening flap 30.

Independent of the type of material constituting the top panel 10 and opening flap 30, the opening flap edges 120 can be discontinuous with the top panel 10 and the opening flap 30 and the free end portion seat 60 can be operably engaged with one another by the locking tab 50 connected to one of the opening flap 30 and the free end portion seat 60 and the locking tab 50 can be mechanically engaged with the other of the opening flap 30 and the free end portion seat 60. For instance, if the locking tab 50 is connected to the opening flap 30, the locking tab 50 can mechanically engage with the free end portion seat 60 to restrain the opening flap 30 from freely swinging open about the hinge 20. Alternatively, if the locking tab 50 is connected to the free end portion seat 60, the locking tab 50 can mechanically engage with the opening flap 30 to restrain the opening flap 30 from freely swinging open about the hinge 20. Net, the locking tab 50 can be connected to the opening flap 30 and mechanically engage with the free end portion seat 60 or the locking tab 50 can be connected to the free end portion seat 60 and mechanically engage with the opening flap 30. Regardless to which structure the locking tab 50 or locking tabs 50 are connected or integral with, the locking tabs 50 can have from about 0.1 mm to about 3 mm, optionally from about 0.2 mm to about 2 mm, optionally about 0.3 mm to about 1 mm of interference with the structure with which it or they interfere. Locking tabs 50 provided on the opening flap edge 120 can project from the opening flap edge by about 0.1 mm to about 3 mm, optionally from about 0.2 mm to about 2 mm, optionally about 0.3 mm to about 1 mm, so as to provide adequate interference between the locking tab 50 and the free end portion seat 60. The force required to lock and or unlock locking tabs increases with an increasing magnitude of interference.

The free end portion 130 can be in facing relationship with the free end portion seat 60 to restrain the opening flap 30 from over rotating into the interior space 90 under reasonable amounts of force applied by the user or weight on the opening flap 30. The area of contact between the free end portion seat 60 and free end portion 130 is greater than the cross sectional area of the free end portion 130 in line with the intersection points 140. Such an arrangement can provide for a large bearing area on the free end portion seat 60 for the free end portion 130 to rest upon.

The hinge 20 can be a continuous hinge 20 along the rotation axis RA of the opening flap 30. Optionally, the hinge 20 can be one or more discrete hinges 20 along the rotation axis RA of the opening flap 30. The hinge 20 can be living hinge. The hinge 20 can be a bi-stable hinge having a higher potential energy state between the position in which the opening flap 30 is fully open and the position in which the opening flap 30 is fully closed than when the hinge 20 is in either such fully open or fully closed position, for example a butterfly living hinge.

The hinge 20 can connect the opening flap 30 to the top panel 10 or a rear panel 150 connected to the top panel 10. In FIG. 1, the hinge 20 is at boundary between the top panel 10 and rear panel 150. This arrangement can be practical if container 1 is a one-piece paperboard. Optionally, the opening flap 30 can extend beyond the boundary between the top panel 10 and rear panel 150 and the hinge 20 can be on the rear panel 150. In such an arrangement, the opening flap edges 120 may contact both the rear panel 150 and the top panel 10 to close the container. This can provide the container with a large aperture through which the contents of the container 1 can be accessed.

The hinge 20 can practically be located in the top panel 10. In such an arrangement, there would be a portion of the top panel 10 between the hinge 20 and the rear panel 150. Such an arrangement can be practical if the container 1 is a one-piece paperboard or if the top panel 10 is a plastic lid fitted to a container body 80 that is a tub. The portion of the top panel 10 between the hinge and the rear panel 150 can provide for additional top load strength and overall stability of the container 1.

To permit the locking tab 50 to move past the edge with which the locking tab 50 engages, it can be convenient to provide for the ability for at least part of the opening flap 30 proximal the free end portion 130 to be able to deform to be even with or below the free end portion seat 60. This can be accomplished by sizing and dimensioning each opening flap edge 120 so that the opening flap edge 120 is in a nonoverlapping relationship with the top panel 10 from the intersection point 40 to along the opening flap edge 120 to a distance of more than about 20% of the separation distance SD. Thus, when the user pushes on the portion of the opening flap 30 between the free end portion 130 and the hinge 20 and nearer to the free end portion 130 than the hinge 20, a portion of the opening flap 30 between the free end portion seat edge 70 and the hinge 20 and nearer to the free end portion seat edge 70 than the hinge 20 can be deformed to be even with or below the free end portion seat 60. This can permit the locking tab 50 and the edge with which the locking tab 50 interferes to move past one another relatively when the opening flap 30 is moved from the closed position to the open position or from the open position to the closed position. Seating of the free end portion 130 on the free end portion seat 60 can resist over rotation of the opening flap 30 to a position in which the free end portion 130 ends up moving past the free end portion seat towards the interior space 90.

The nonoverlapping relationship amongst the opening flap edge 120 and the top panel 10 can be an abutting relationship. An abutting relationship is one in which the edges of the two planar elements are side by side with one another and the planar elements can freely move relative to one another in directions orthogonal to the planar element.

Figure 2:
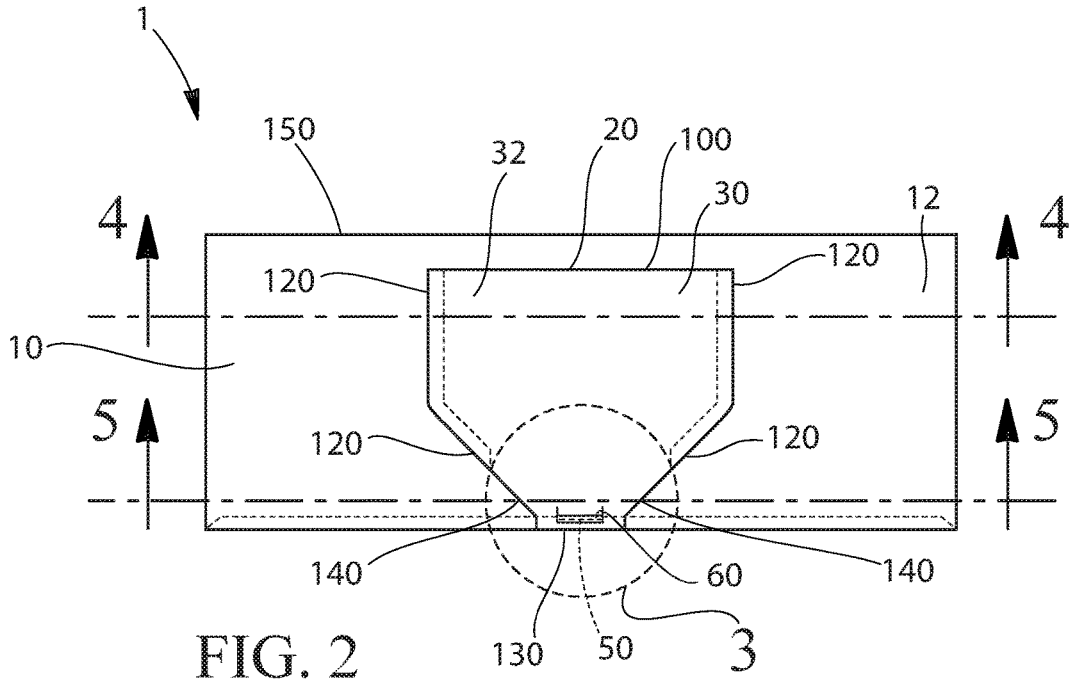
FIG. 2 is a top view of a container.
Figure 3:
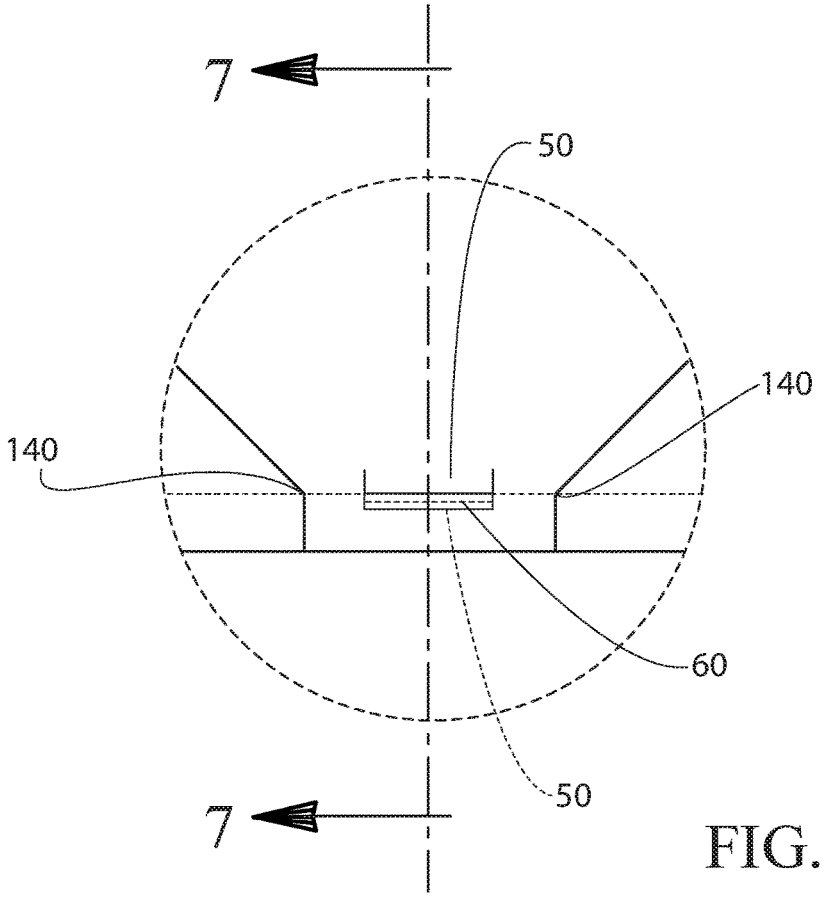
FIG. 3 is partial view as denoted in FIG. 2.

A top view of a container 1 is shown in FIGS. 2 and 3. In FIG. 2, the hinge 20 is shown to connect the opening flap 30 to the top panel 10. The locking tab 50 is centrally located proximal the free end portion 130 and is positioned towards the interior space 90 and locked underneath the free end portion seat edge 70. That is, the locking tab 50 and the free end portion 130 can be on opposite sides of the free end portion seat 70. The locking tab 50 in this position can impede the opening flap 30 from opening. The locking tab 50 can interfere with the free end portion seat edge by about 0.1 mm to about 3 mm, optionally from about 0.2 mm to about 2 mm, optionally about 0.3 mm to about 1 mm, to provide for the ability to securely close the opening flap 30.

Figure 4:
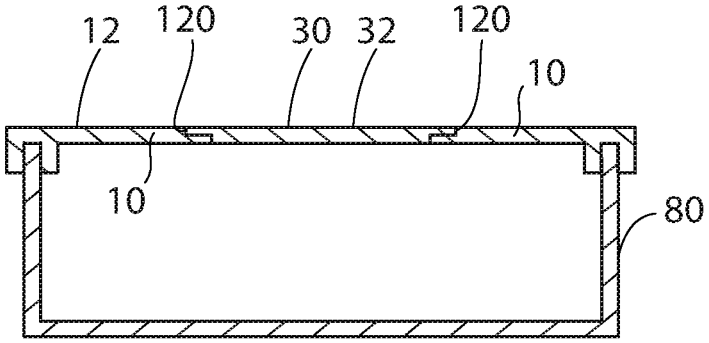
FIG. 4 is a cross section view as marked in FIG. 2.

A cross section of the container 1 in FIG. 2 is shown in FIG. 4. Along at least a portion of the opening flap edges 120 from proximal the hinged portion 100 towards the locking tab 50, or locking tabs 50, the opening flap 30 can overlap the top panel 10. The overlap can help reduce the potential for the opening flap 30 to over rotate into the interior space 90 of the container 1. Together, the free end portion 130 resting on the free end portion seat 60 and the overlapping portions of the opening flap edges 120 can inhibit over rotation of the opening flap 30.

Figure 5:
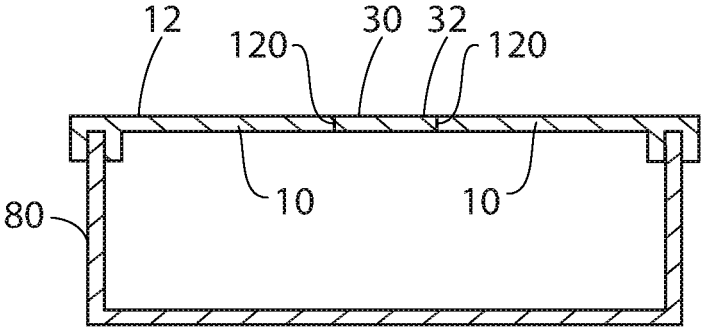
FIG. 5 is a cross section view as marked in FIG. 2.
Figure 6:
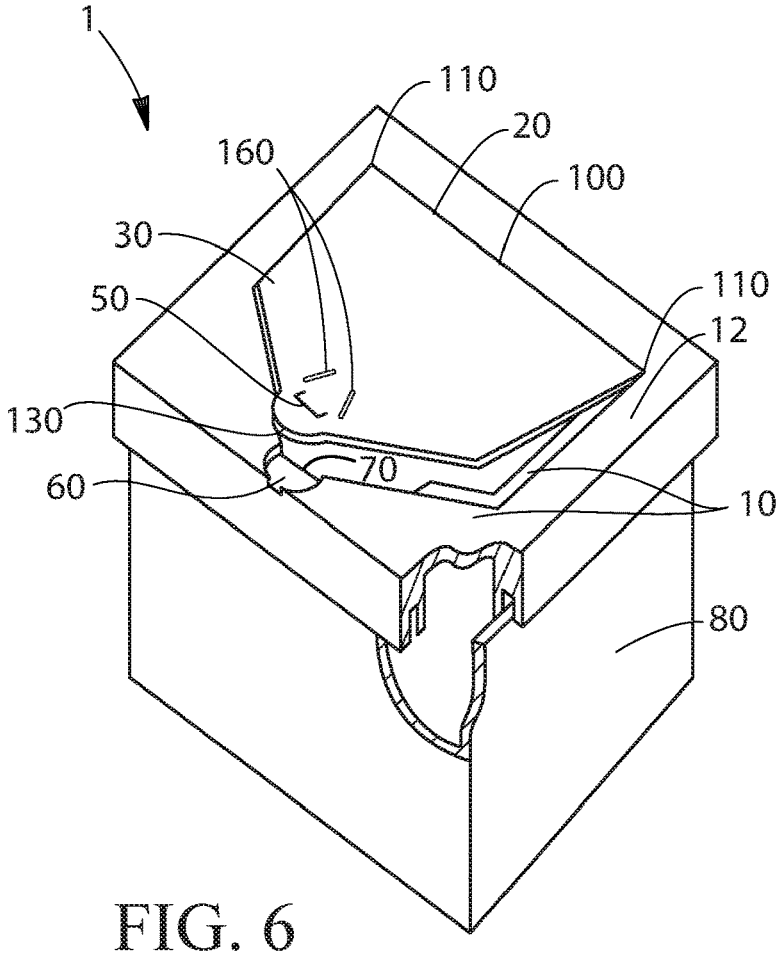
FIG. 6 is container having a top panel engaged with a container body.

As described herein, the opening flap edge 120 can be in a nonoverlapping relationship with the top panel 10 from the intersection portion 140 to along the opening flap edge 120 to a distance of more than about 20% of the separation distance SD. An example of a nonoverlapping relationship proximal the free end portion 130 is shown in FIG. 5, which is another cross section of the container shown in FIG. 2. In FIG. 5, the opening flap edges 120 abut the top panel 10. Also shown in FIG. 5 is the opening flap interior facing surface 33. A container 1 in which the opening flap 30 is in an open position is shown in FIG. 6. As shown in FIG. 6, the when the opening flap 30 is closed, the free end portion 130 can be in facing relationship with the free end portion seat 60. The opening flap 30 can be closed by the user by pushing the opening flap 30 at a location between the locking tab 50 and the hinged portion 100 and nearer to the locking tab 50 than the hinged portion 100. When the free end portion 130 is positioned to be in facing relationship with the free end portion 60, further pushing in such location, which can be location that is between portions of the opening flap edges 120 that are in a nonoverlapping relationship with the top panel 10, can bend opening flap 30 and cause the locking tab 50 to bend out plane with respect to portions of the opening flap 30 immediately surrounding the locking tab 50 and force the locking tab 50 to engage with the free end portion seat 60. Optionally, the user can push downwardly on the locking tab 50 itself to force the locking tab 50 out of plane as compared to portions of the opening flap 30 immediately surrounding the locking tab 50 and slip over the free end portion seat edge 70 to engage with the free end portion seat 60. The nonoverlapping relationship with the top panel 10 near free end portion 130 allows for deformation of the opening flap 30 proximal the free end portion 130 and between portions opening flap 30 between the portions of the opening flap edges 120 that are in a nonoverlapping relationship with the top panel 10 which in effect creates space for locking tab 50 to move past the free end portion seat edge 70.

To provide for more control of deformation of the opening flap 30 proximal the free end portion 130 when the user closes the opening flap 30, the opening flap 30 can be provided with one or more weakened portions 160. The opening flap 30 can comprise a weakened portion 160 between portions of the overlapping flap edges 120 that are in nonoverlapping relationship with the top panel 10 and between the free end portion seat edge 70 and the hinged portion 100 and nearer to the free end portion seat edge 70 than the hinged portion 100. The weakened portion 160 can be a crease or score line if a paperboard top panel 10 or if a one-piece paperboard is used to construct the container. The weakened portion 160 can be a discrete portion of the opening flap 30 that is thinner than portions of the opening flap adjacent the weakened portion 160. The weakened portion 160 can have an arc shape open towards the free end portion 130.

Figure 7:
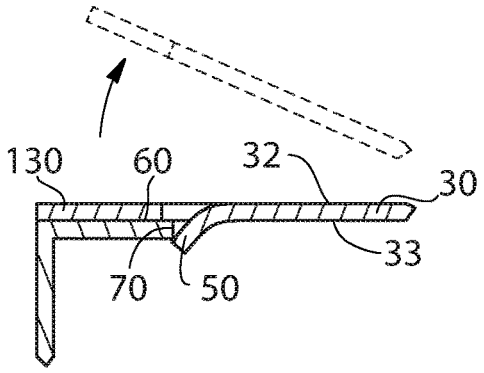
FIG. 7 is a cross section view of a locking tab in the opening flap engaged with the free end portion seat.

A cross sectional view of the portion of the container 1 shown in FIG. 3 is shown in FIG. 7. The locking tab 50 can be part of the opening flap 30 and positioned between the free end portion 130 and the hinged portion 100. Such arrangements are shown in FIGS. 1-6. The locking tab 50 when engaged with the free end portion seat 60 can be beneath the free end portion seat 60 and or free end portion seat edge 70. The more interference there is between the locking tab 50 and free end portion seat 60 the more force that will be required to open the opening flap 30 since the locking tab 50 must be bent more or moved more by deformation of the opening flap 30 to dislodge it over the free end portion seat 60 and free end portion seat edge. The locking tab 50 or locking tabs 50 can have from about 0.1 mm to about 3 mm, optionally from about 0.2 mm to about 2 mm, optionally about 0.3 mm to about 1 mm of interference with the free end portion seat 60. As shown in FIG. 6, when the opening flap 30 is in the closed position, the free end portion seat 60 can be between the locking tab 50 and the free end portion 130. That is, the locking tab 50 can be beneath the free end portion seat 60 or free end portion seat edge 70.

Figure 8:
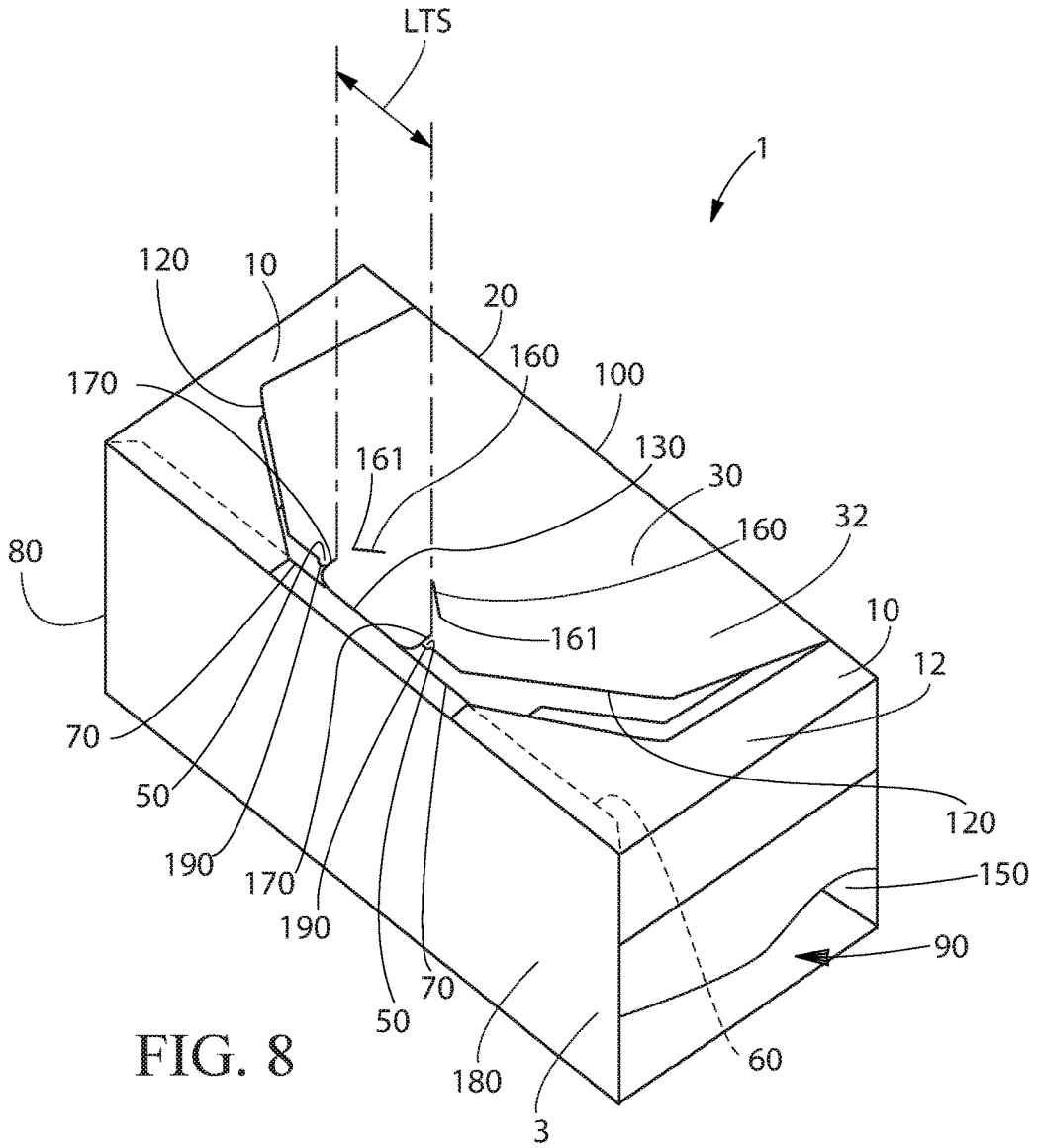
FIG. 8 is container in which the locking tabs are provided on the opening flap edges. A portion of the sides of the container are removed so that the interior space and interior surface of the front panel, the bottom panel, and the rear panel are visible.

The container 1 can comprise two locking tabs 50, for example as shown in FIG. 8. In FIG. 8, the opening flap 30 is illustrated to be in a slightly opened position. The free end portion 130 can be between the locking tabs 50. The locking tabs 50 can be engaged with and extend away from one of the opening flap edge 120 and the free end portion seat edge 70. In FIG. 8, the locking tabs 50 are illustrated to be engaged with and extend away from the opening flap 30.

The locking tabs 50 may be engaged with the opening flap by being integral with the opening flap 30. That is, the locking tabs 50 may be continuous extensions of the opening flap 30. This can be conveniently provided for when a one-piece paperboard constitutes the container 1 and the one-piece paperboard is die cut to form a blank that can be folded into a container 1 having all of the requisite features. Optionally the top panel 10 and opening flap 30 can be a molded plastic part, for example an injection molded part or thermoformed part. The locking tabs 50 may be integrally molded parts or formed by a multistage injection molding process or joined to opening flap 30 as desired. The locking tabs 50 may be spaced apart by a locking tab spacing between the locking tabs 50 of from about 10 mm to about 100 mm, optionally from about 10 mm to about 60 mm, optionally from about 20 mm to about 60 mm, optionally about 40 mm Such spacing of the locking tabs 50 can permit the locking tabs 50 to lock into place with an acceptable amount of deformation of the opening flap 30 and or free end portion seat 60. The same such spacing may be practical if the locking tabs 50 extend from the free end portion seat 60.

The user can transition the opening flap 30 from an open position, as shown in FIG. 8, to a closed position, by pressing the opening flap 30 at a location proximal the free end portion 130 that will, when the opening flap 30 is closed, end up being between the free end portion seat edge 70 and the hinged portion 100. As the user pushes the opening flap 30 down, the free end portion 130 can come into facing relationship with the free end portion seat 60. Further slight pushing on the opening flap 30 can deform the opening flap 30 which can move the locking tabs 50 towards the hinge 20. The locking tabs 50 can then mechanically engage with the opening flap edge 120. Optionally, the locking tabs 50 can slip over or pass by the free end portion seat edge 70 so that the locking tabs 50 end up positioned beneath the free end portion seat 60. Resistance to the opening flap 30 unintentionally opening can be provided by mechanical engagement of the locking tabs 50 with the free end portion seat edge 70 and or free end portion seat 60. To open the opening flap 30, the user can conveniently lift the free end portion 130 up and away from the free end portion seat 60 and the locking tabs 50 can be disengaged from the free end portion seat 60 and or free end portion seat edge 70 and the opening flap 30 can be swung open. Lifting force applied to the free end portion 130 can be transferred to the locking tabs 50 which bend to get past the free end portion seat edge 70 or force from the locking tabs 50 can be transferred to one or both of the free end portion seat edge 70 and opening flap 30 to deform to provide room for the locking tabs 50 to get past the structure with which they are engaged.

The locking tabs 50 can be separated from one another by a locking tab spacing LTS. Each of the opening flap edges 120 can be in a nonoverlapping relationship with the top panel 10 from the locking tabs 50 to along the opening flap edge 120 to a distance of more than about 20% of the locking tab spacing LTS. The opening flap edges 120 can be in a nonoverlapping relationship with the top panel 10 from the locking tabs 50 up to a total of an entirety of the opening flap edge 120 being in nonoverlapping relationship with the top panel 10. The nonoverlapping relationship of the opening flap edge 120 and top panel 10 near the locking tabs 50 can provide the opening flap 30 with the ability to deform in a manner that helps the locking tabs 50 get out of the way of free end portion seat edge 70 as opening flap 30 is pushed to be in a closed position. When the user releases the closing force, that portion of the opening flap 30 can flatten out, thereby engaging the locking tabs 50 with the free end portion seat edge 70 and or free end portion seat 60.

It can be practical to provide an opening flap 30 wherein along at least a portion of the opening flap edges 120 from proximal the hinged portion 100 ends 110 towards the locking tabs 50 the opening flap 30 overlaps the top panel 30. Over rotation of the opening flap 30 towards the interior space 90 of the container 1 may be resisted by a portion or portions of the opening flap 30 that overlap with the top panel 10.

A slit 170 can be provided between each locking tab 50 and the free end portion 130. A slit 170 can be practical for providing flexibility to the locking tab 50 beyond the flexibility inherent to the constituent material. If the manner in which the opening flap 30 is transitioned from an open position to a closed position results in the free end portion seat edge 70 interfering with movement of a locking tab 50 into engagement with the free end portion seat edge 70 or free end portion seat 60, the slit 170 effectively lengthens the locking tab 50 thereby reducing the stiffness of the locking tab 50. The slit 170 can have a length from about 0.1 mm to about 5 mm. The slit 170 can have a length that is from about 1 times to about 10 times the thickness of the opening flap 30. Such a range may provide for suitable flexure of the locking tab 50. In an arrangement in which the container 1 comprises two locking tabs 50 and the free end portion 130 is between the locking tabs 50, it can be practical for the opening flap 30 to comprise one or more weakened portions 160 having a weakened portion end 161 or weakened portion ends 161 oriented towards the locking tabs 50. The weakened portion 160 or weakened portions 160 can provide for preferential and controlled deformation of the opening flap 30. That is, the opening flap 30 can be provided with enough flexibility near the free end portion 130 to enable the locking tabs 50 to get past the structure with which they engage and much of the of the deformation of the opening flap 30 is constrained to locations near the weakened portions 160, as opposed to other areas of the opening flap 30. Weakened portions 160 provided between portions of the overlapping flap edges 120 that are in nonoverlapping relationship with the top panel 10 and between the free end portion seat edge 70 and the hinged portion 100 and nearer to the free end portion seat edge 70 than the hinged portion 100 can provide for enhanced flexibility of the opening flap 30 near the locking tabs 50.

As shown in FIG. 8, the container body 80 can comprise a front panel 180 extending from the free end portion seat 60. The free end portion seat 60 can be joined to the top panel interior facing surface. The locking tabs 50 can be integral with and extend away from the opening flap edge 120 towards the front panel 180. The locking tabs 50 can have locking tab edges 190 oriented towards the front panel 180 and the locking tab edges 190 can be nearer to the front panel 180 than the free end portion seat edge 70. The locking tabs 50 can project away from the opening flap edge 120 by about 0.1 mm to about 3 mm, optionally from about 0.2 mm to about 2 mm, optionally about 0.3 mm to about 1 mm, to provide for adequate interference between the locking tabs 50 and the opening seat 60 to securely close the opening flap.

This arrangement can be conveniently provided for by constructing the container 1 from one piece of paperboard cut in a manner so that when the one-piece paperboard is folded to construct the container 1, the container 1 has the desired features in the desired locations. In the arrangement shown in FIG. 8, the front panel 180 is connected to the top panel 10 via a bottom panel opposite the top panel 10 and a rear panel 150 opposite the front panel 180, and the free end portion seat 60, front panel 180, bottom panel, rear panel 150, and top panel 10 are formed a single contiguous piece of paperboard. The front panel 180 is also connected to the top panel 10 through the free end portion seat 60.

Figure 9:
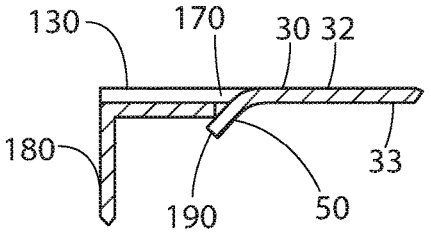
FIG. 9 is a cross section view of a locking tab on the opening flap edge operably engaged with the free end portion seat.

When the opening flap 30 of the container 1 shown in FIG. 8 is closed, the locking tabs 50 can engage with the free end portion seat edge 70 as shown in FIG. 9, which is a cross section of the pertinent parts of the opening flap 30, locking tab 50, and free end portion seat edge 70, with the cross section taken through a locking tab 50. When the opening flap 30 is closed, the locking tab 50 can engage with end portion seat edge 70 or be positioned under the opening seat edge 70 to resist opening of the opening flap 30. By providing the locking tab edges 190 nearer to the front panel 180 than the free end portion seat edge 70, the free end portion seat edge 70 will interfere with the locking tabs 50 when the opening flap 30 is pushed closed. As the user pushes the opening flap 30 closed, as the locking tabs 50 move from being above the free end portion seat edge 70 to below the free end portion seat edge 70, an audible click can be emitted as the locking tabs slip over the free end portion seat edge 70 or the locking tabs 50 snap into place. The audible click can reassure the user of the container 30 that opening flap 30 is securely closed.

For a one-piece paperboard container 1, it can be practical to provide reverse cuts to define the distinction between the top panel 10 and the opening flap 30. Reverse cuts are partial cuts in opposite sides of the paperboard with the cuts being offset from one another.

Figure 10:
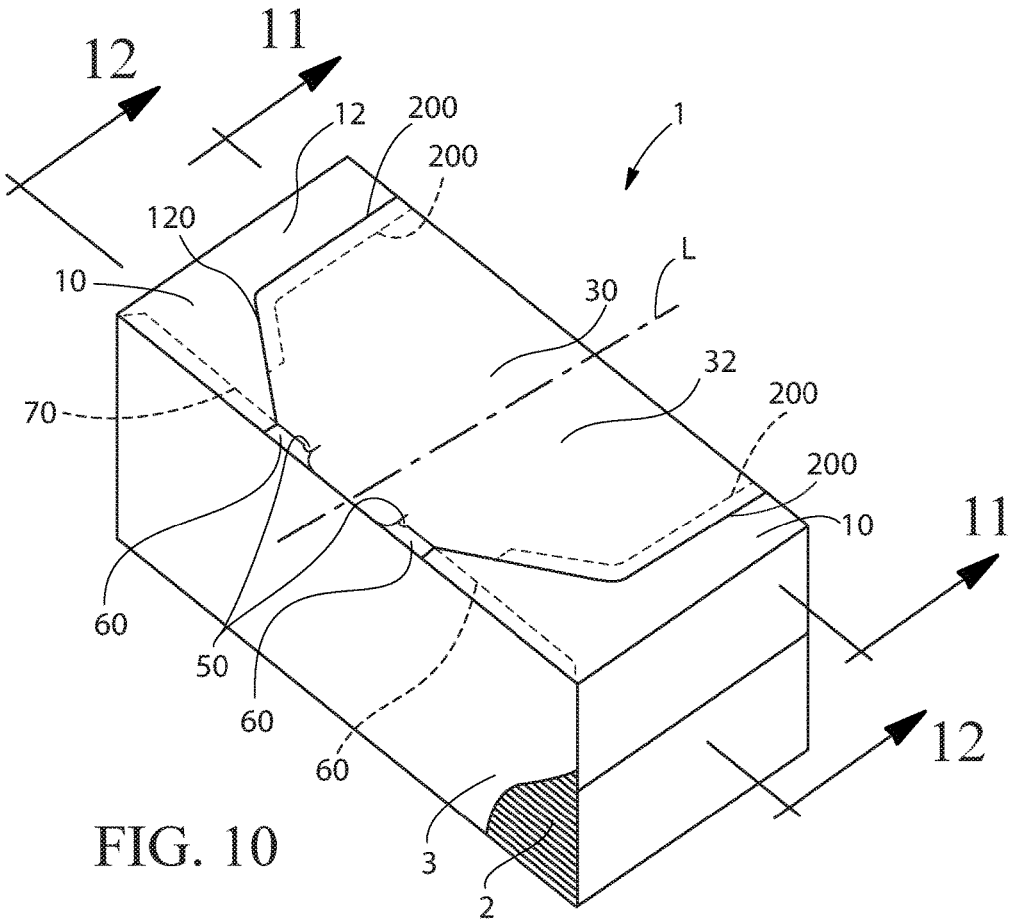
FIG. 10 is a container in an unopened condition. The locking tabs are connected to the opening flap edges and the free end portion is between the locking tabs.

A one-piece paperboard container 1 is shown in FIG. 10, with locations of various cross sections marked. In the embodiment of container 1 shown in FIG. 10, the container 1 is yet to be opened after erection of the container 1. Reverse cuts 200 are provided at portions of the boundaries of the top panel 10 and opening flap 30. The reverse cuts 200 can extend from or proximally from the hinged portion ends 110 towards the locking tabs 50, wherein at a distance from the locking tabs 50 of more than about 20% of the locking tab spacing the reverse cuts 200 merge. Also, shown in FIG. 10, the container 1 can contain a plurality of fabric treatment articles 2. The opening flap 30 has a longitudinal axis L orthogonal to the hinge 20 and passing through the free end portion 130.

Figure 11:
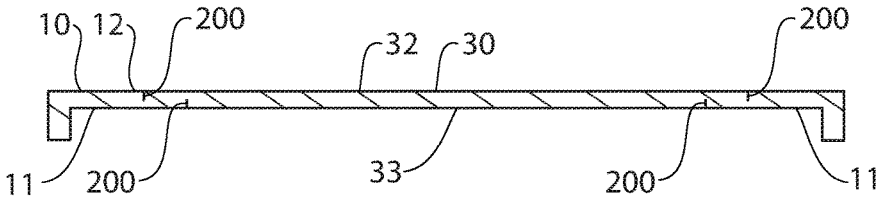
FIG. 11 is a cross section of a container as marked in FIG. 10.

In the cross section shown in FIG. 11, the reverse cuts 200 are shown to be on opposite sides of the top panel 10. The reverse cuts 200 are offset from one another, one cut made from the upper surface of the top panel 10 and the other offset cut made from the lower surface of the top panel 10. Each reverse cut 200 can penetrate from about 25% to about 75% of the thickness of the paperboard. The reverse cuts 200 can be characterized by a pair of continuous offset parallel cuts on opposing sides of the paper board. Of course, the reverse cuts need not be straight or parallel to one another if decoration, for example a wavy tear line or tapered tear line, is to be provided by the shape of the tear line formed by the reverse cuts 200 or if it is desirable that variable amounts of force be required to provide delamination between the reverse cuts 200. When the opening flap 30 is formed by pulling on the free end portion 130, the area of the paperboard between the reverse cuts 200 delaminates. The reverse cuts 200 can provide for opening flap edges 120 that are separable from the top panel 10.

The reverse cuts 200 can merge into a single through cut or a tear line at a location more than about 20% of the locking tab spacing LTS away from the locking tabs 50. If a tear line is employed, the tear line can be perforations, partial perforations, a score line, or other structure designed to provide for separation across the tear line when sheared or placed under tension across the tear line.

At the location at which the cross section shown in FIG. 11 is taken, when the structure of the opening flap 30 is formed by pulling on the free end portion 130 and tearing the reverse cuts 200, the part of the opening flap edge 120 formed from tearing the reverse cuts 200 will provide for part of the opening flap edge 120 being in overlapping relationship with the top panel 10. The top panel interior facing surface 11 is also shown in FIG. 11. The opening flap 30 can be considered to have an opening flap outer surface 31 and an opposing opening flap inner surface 32. The opening flap inner surface 32 is oriented towards the interior space 90. In the portion of the opening flap 30 having reverse cuts 200, the reverse cuts 200 made on the opening flap inner surface 32 can be closer to the longitudinal axis L of the opening flap than the reverse cuts made on the opening flap outer surface 31. Such an arrangement can provide for neat delamination of the opening flap 30 from the top panel 10.

Figure 12:
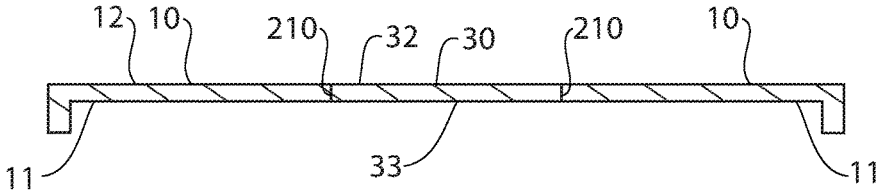
FIG. 12 is a cross section of a container as marked in FIG. 10.

As shown in the cross section shown in FIG. 12, a line of weakness 210 can be provided in the top panel 10 to at least partially define the structure that becomes part of the opening flap edges 120 when the container 1 is first opened. The line of weakness 210 can create the nonoverlapping relationship amongst the opening flap edge 120 and the top panel 10, which can be an abutting relationship. The line of weakness 210 can be a through cut, a frangible line, a score line, a perforated line, partial die cut, partial die cut on opposing surfaces, or the like. The line of weakness 210 can be a zipper cut.

The experience of the user of the container 1 when first opening the container 1 can be as follows. The user lifts the free end portion 130 from the free end portion seat 60. The portion of what is to become the portion of the opening flap edge 120 that is in nonoverlapping relationship with the top panel 10 lifts easily as the opening flap edge 120 separates from the top panel 10 along the line of weakness 210. Further lifting of the free end portion 130 applies stress across the reverse cuts 200 and the paperboard between the reverse cuts 200 separates by delamination. Delamination runs along the reverse cuts 200 towards and to the hinged portion end 110.

It can be convenient for the container 1 to comprise a one-piece paperboard. That is, the free end portion seat 60, front panel 180, top panel 10, opening flap 30, and rear panel 150 can be a one-piece paperboard. The container body 80 can comprise a front panel 180 extending from the free end portion seat 60 and the free end portion seat 60 can be connected to the top panel 10. The container body 80 can comprise a rear panel 150 connected to the top panel 10. The hinge 20 can connect the opening flap 30 to the top panel 30 or the rear panel 150. In the embodiment shown in FIG. 8, the container 1 is a parallelepiped container 1. The container 1 can be an irregular polyhedron.

Figure 13:
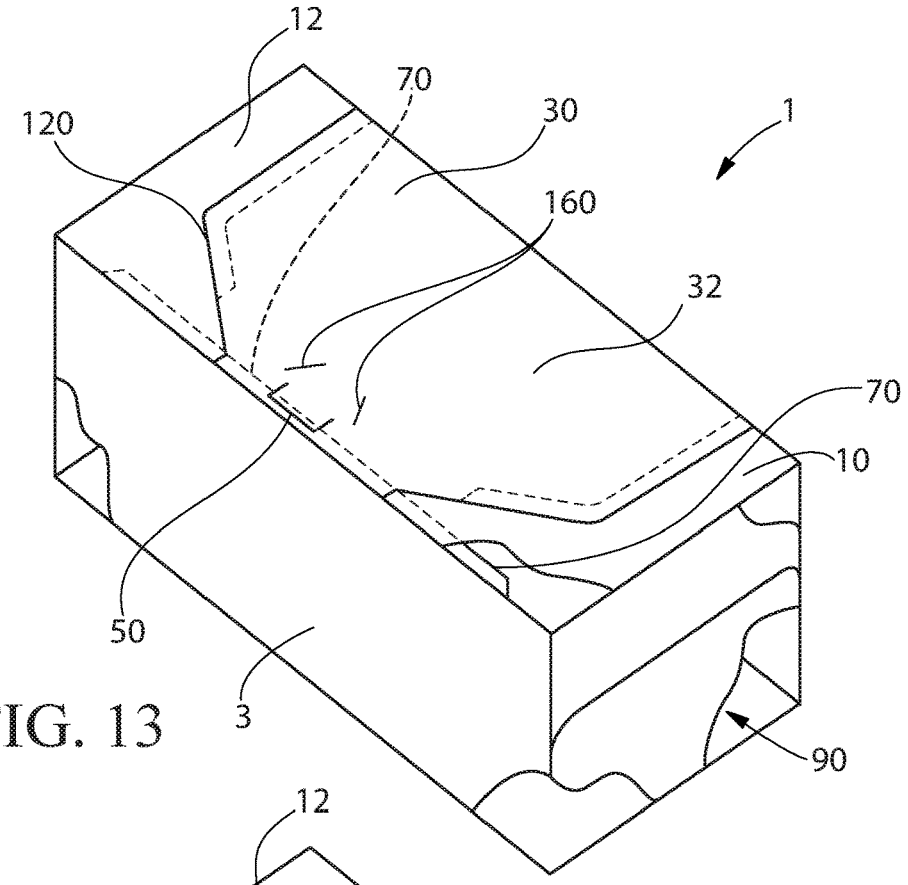
FIG. 13 is a container in an unopened condition. The locking tab is provided in the opening flap. A portion of the front panel and sides of the container are removed so that the interior space, bottom panel, and rear panel are visible.

FIG. 13 is a container 1 in which the locking tab 50 is integral with the opening flap 30 and the locking tab 50 projects beyond the free end portion seat edge 70. The opening flap edge 120 can be in a nonoverlapping relationship with the top panel 10 proximal the free end portion 130. The nonoverlapping relationship can be an abutting relationship. At least a portion of the opening flap edges 120 and the top panel 10 are separable from one another by a reverse cut structure. The container body 80 can comprise a one-piece paperboard. The locking tab 50 can project beyond the free end portion seat edge 70 by about 0.1 mm to about 3 mm, optionally from about 0.2 mm to about 2 mm, optionally about 0.3 mm to about 1 mm Such a magnitude of projection can provide for enough interference between the locking tab 50 and the free end portion seat 60 to securely close the opening flap 30.

Figure 14:
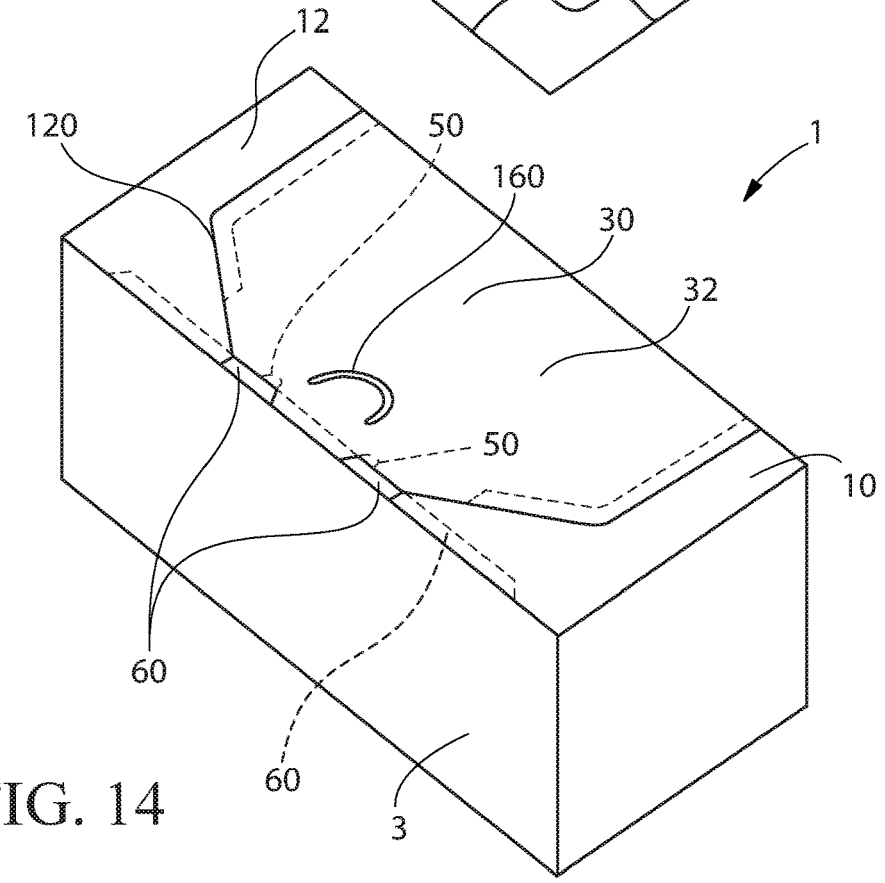
FIG. 14 is a container in an unopened condition. The locking tabs extend from the free end portion seat edge.

FIG. 14 contrasts with the container 1 shown in FIGS. 8 and 10 in that the locking tabs 50 are connected to the free end portion seat edge 70. The locking tabs 50 can project from the free end portion seat edge 70 by about 0.1 mm to about 3 mm, optionally from about 0.2 mm to about 2 mm, optionally about 0.3 mm to about 1 mm to provide for secure closure of the opening flap 30. The container 1 shown in FIG. 14 can be conveniently comprise a container body engaged with the top panel 10. The top panel 10, the opening flap 30, and the container body 80 can together define the interior space 90. The container body 80, the free end portion seat 60, the locking tabs 50, the top panel 10, and the opening flap 30 can be one-piece paperboard 3. When these elements are a one-piece paperboard 3, the elements are integral with one another. That is, the elements are continuous uninterrupted paperboard 3.

Figure 15:
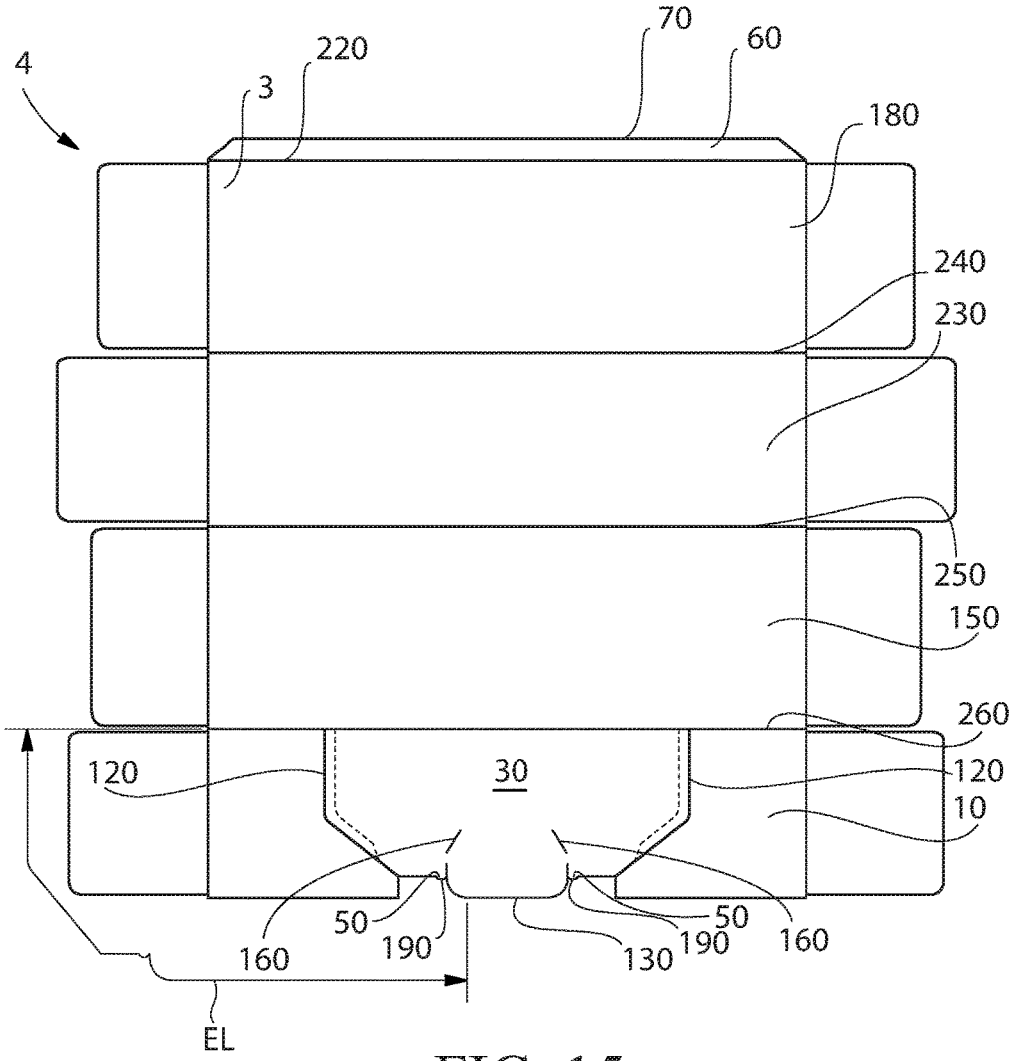
FIG. 15 is a blank for constructing a container of the general configuration shown in FIG. 10.
Figure 16:
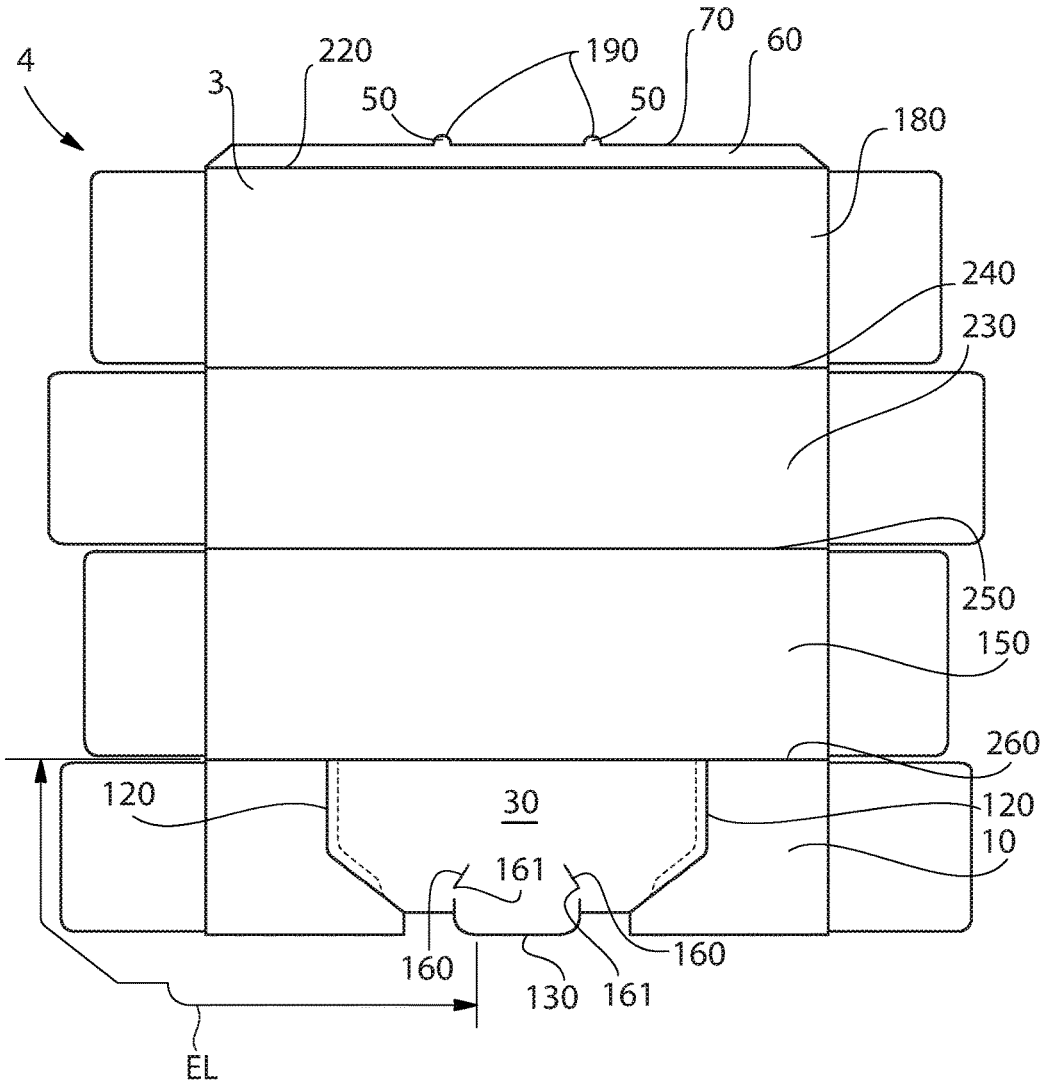
FIG. 16 is a blank for constructing a container of the general configuration shown in FIG. 14.
Figure 17:
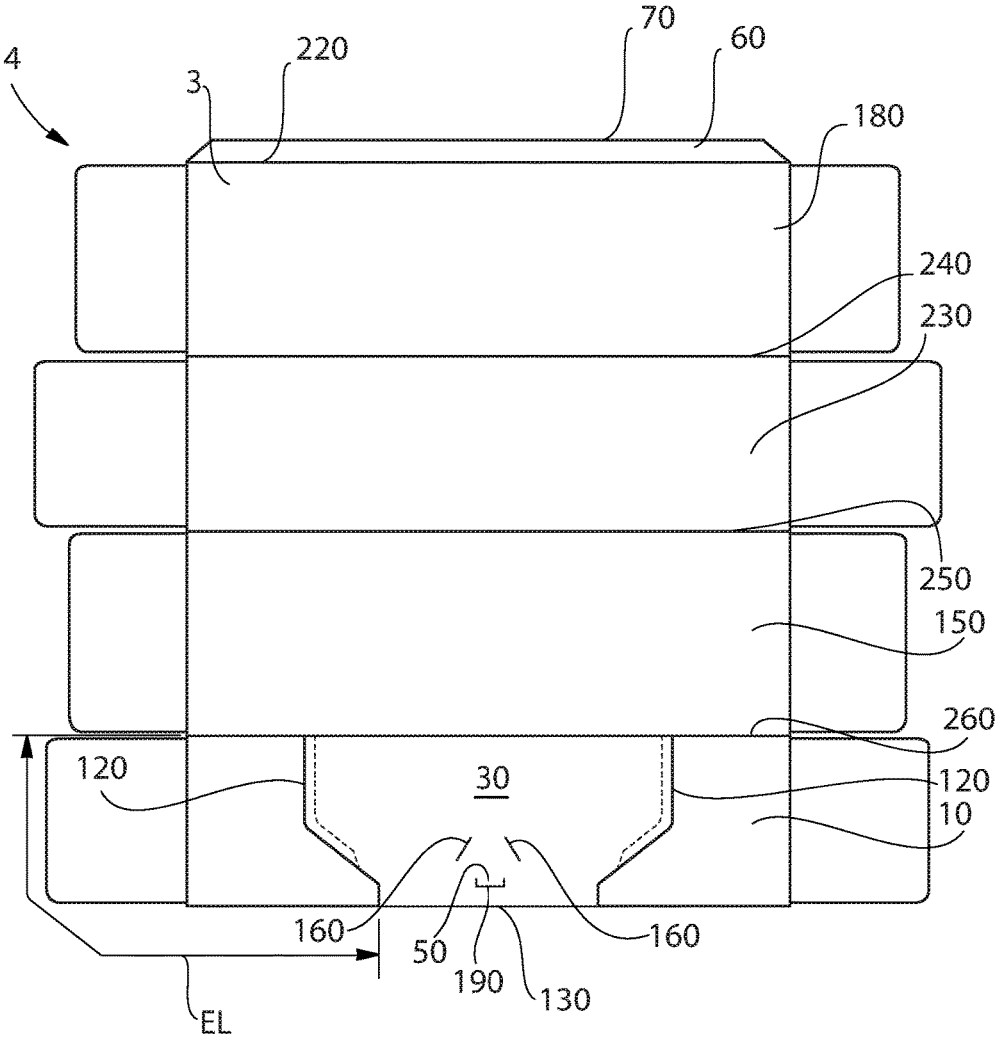
FIG. 17 is a blank for constructing a container of the general configuration shown in FIG. 13.

A container 1 comprising a one-piece paperboard forming the container body 80, free end portion seat 60, locking tab 50 or locking tabs 50, top panel 10, and opening flap 30, can be fabricated from a carton blank. Carton blanks 4 are shown in FIGS. 15, 16, and 17.

The blank 4 can comprise a free end portion seat 60 having a free end portion seat edge 70. The blank 4 can further comprise a front panel 180 extending from and integral with the free end portion seat 60 across a first fold line 220. The blank 4 can further comprise a bottom panel 230 extending from and integral with the front panel 180 across a second fold line 240. A rear panel 150 can extend from and be integral with the bottom panel 230 across a third fold line 250. A top panel 10 can extend from and be integral with the rear panel 150 across a fourth fold line 260. The blank 4 can further comprise an open flap 30 connected to the top panel 10 or the rear panel 150 by a hinge 20. The opening flap 30 can comprise a hinged portion 100 having two hinged portion end 110. Two opening flap edges 120 can be at least partially defined by reverse cuts 200 extending from extending from the hinged portion ends 110 towards an free end portion 130 opposing the hinged portion 100. Each opening flap edge 120 can have an opening flap edge length EL between the hinged portion end 110 and the free end portion 130. The opening flap edge length EL is a scalar quantity that is measured from the hinged portion end 110 to the free end portion 130 along the opening flap edge 120 or what ultimately becomes the opening flap edge 120 when the container 1 is opened. The free end portion 130 is the point or edge of the opening flap 30 that is furthest away from the hinge 20. If the free end portion 130 is a straight line segment, then the measurement of the opening flap edge length EL is made from the hinged portion end 110 to the end of the straight line segment that is or forms the free end portion 130 nearest to the hinged portion end 110 from which the measurement is made. If the free end portion 130 is a straight line segment that is parallel to the hinge 20, then the measurement of the opening flap edge length EL is made from the hinged portion end 110 to the end of the straight line segment that is the free end portion 130 nearest to the hinged portion end 110 from which the measurement is made. If the free end portion 130 is point on the opening flap edge 120 furtherst from the hinge 20, for example for an opening flap 30 shaped as shown in FIG. 6 in which the opening flap 30 is curved proximal the opening flap free end portion 130, then the opening flap edge length EL is made from the hinged portion end 110 to the point that is the free end portion 130. Note that the opening flap edge length EL includes the functional or decorative shaping that is provided to opening flap 30 as the opening flap edge 120 approaches, or in other words is proximal to, the opening flap free end portion 130, but does not include slits 170 next to the locking tabs 50 if provided. The reverse cuts 200 can merge at a position more than about 10% of the opening flap edge length EL away from the free end portion 130. The fold lines may be a crease in the one-piece paperboard 3 constituting the blank 4. The crease may be from about 90% to about 10% of the thickness of one-piece paperboard 3 away from the crease. Optionally, the fold lines may be a score in the one-piece paperboard 3 penetrating the one-piece paperboard 3 to a depth of 10% to about 90% of the thickness of the one-piece paperboard 3 away from the score.

One or more locking tabs 50 can be provided at a location selected from the group consisting of extending from and integral with said opening flap edge, extending from and integral with said free end portion seat edge 70, and in said opening flap between said hinge 20 and said free end portion 130 and nearer to said free end portion 130 than said hinge 20. One or more locking tabs 50 can be provided at a location selected from the group consisting of extending from and integral with said opening flap edge, extending from and integral with said free end portion seat edge 70, and in said opening flap 30 nearer to the free end portion 130 than a distance between the first fold line 220 and the free end portion seat edge 70. The locking tabs 50 can extend away from the free end portion 130 by about 0.1 mm to about 3 mm, optionally from about 0.2 mm to about 2 mm, optionally about 0.3 mm to about 1 mm to provide for secure closure of the opening flap 30. If locking tabs 50 extend from the free end portion seat edge, they can extend therefrom by the same aforesaid magnitudes with the same prospective benefit.

The blank 4 can be a die cut one-piece paperboard 3. Die-cut blanks 4 can be cut from paperboard using a die cutting press with blanking and stripping sections to convert sheets or of paperboard or a roll of paperboard into blanks 4. The blank 4 can be erected into the container 1 manually or using an automated carton erector.

The container 1 disclosed herein can be suitable for containing a variety of solid objects. The container 1 can be plastic container 1 in which a top panel 10 having an opening flap 30 is engaged with a plastic tub. Such a container 1 can be convenient for storing loose items, particularly loose solid items.

The container 1 disclosed herein can be suitable for containing a plurality of articles 2 comprising perfume. The container 1 disclosed herein can be suitable for containing a plurality of fabric treatment articles 2 or solid fabric treatment compositions such as powders, beads, and the like. The fabric treatment articles 2 can be selected from the group consisting of water soluble films comprising fabric treatment agents, water soluble foam comprising fabric treatment agent, water soluble particles comprising fabric treatment agent, water soluble fibrous sheets comprising fabric treatment agent, fibrous sheets comprising fabric treatment agent, water insoluble fibrous sheets comprising fabric treatment agent. The fabric treatment agent can be selected from the group consisting of surfactant, fabric softener, unencapsulated perfume, encapsulated perfume, and combinations thereof. The fibrous fabric treatment articles 2 can be dryer sheets comprising a fabric softening active, optionally a quaternary ammonium compound. Without being bound by theory it is thought that by providing a locking tab 50 or locking tabs 50 to securely close the container 1 and providing an overlapping relationship in a portion or portions of the opening flap edges 120 that contents of the container 1 can be protected from the external environment. If the fabric treatment articles 2 comprise unencapsulated perfume or encapsulated perfume, it is thought that by providing a locking tab 50 or locking tabs 50 to securely close the container 1 and providing an overlapping relationship in a portion or portions of the opening flap edges 120 loss of perfume from the fabric treatment articles can be reduced as compared to a similarly dimensioned carton without the locking tab 50 or locking tabs 50 and the reverse cuts 200.

The one-piece paperboard 3 can have a thickness from about 0.1 mm to about 4 mm, optionally from about 0.2 mm to about 2 mm, optionally from about 0.3 mm to about 1 mm, optionally about 0.7 mm. The paperboard 3 can be a laminate paperboard 3. The paperboard 3 can have one or more coatings, for instance to provide for a surface suitable for printing or to provide a barrier function, such as a moisture barrier. The one-piece paperboard 3 can be solid bleached board, solid bleached sulfate paperboard, foil-coated paperboard, film-coated paperboard, wax-coated paperboard, solid unbleached board, folding box board, white lined chipboard, and the like.

Combinations:

An example is below:

A. A container (1) comprising:

a top panel (10) having a top panel exterior facing surface (12); a hinge (20);

an opening flap (30) connected to said hinge; a locking tab (50) connected to one of said opening flap and a free end portion seat (60) having a free end portion seat edge (70), wherein said free end portion seat is recessed relative to said top panel exterior facing surface; and a container body (80) engaged with said top panel, wherein said top panel, said opening flap, and said container body together define an interior space (90); wherein said opening flap comprises; a hinged portion (100) having two hinged portion ends (110); a free end portion (130) in facing relationship with said free end portion seat; two opening flap edges (120) separable from said top panel, each opening flap edge extending from one of said hinged portion ends to said free end portion; and wherein said free end portion overlies said free end portion seat edge between two intersection points (140) separated by a separation distance (SD); and wherein for each opening flap edge, said opening flap edge is in a nonoverlapping relationship with said top panel from said intersection point to along said opening flap edge to a distance of more than about 20% of said separation distance; wherein said locking tab is closer to said hinge than said free end portion is to said hinge.

B. The container according to Paragraph A, wherein said opening flap edges are discontinuous with said top panel and said opening flap and said free end portion seat are operably engaged with one another by said locking tab connected to one of said opening flap and said free end portion seat and said locking tab is mechanically engaged with the other of said opening flap and said free end portion seat.

C. The container according to Paragraph A or B, wherein said nonoverlapping relationship is an abutting relationship.

D. The container according to any of Paragraphs A to C, wherein said hinge connects said opening flap to said top panel or a rear panel (150) connected to said top panel, said container body further comprising said rear panel.

E. The container according to any of Paragraphs A to D, wherein along at least a portion of said opening flap edges from proximal said hinged portion ends towards said locking tab said opening flap overlaps said top panel.

F. The container according to any of Paragraphs A to E, wherein said container comprises two said locking tabs and said free end portion is between said locking tabs, wherein said locking tabs are engaged with and extend away from one of said opening flap edge and said free end portion seat edge.

G. The container according to Paragraph F, wherein said locking tabs are separated from one another by a locking tab spacing (LTS) and each of said opening flap edges is in a nonoverlapping relationship with said top panel from said locking tabs to along said opening flap edge to a distance of more than about 20% of said locking tab spacing.

H. The container according to Paragraph G, wherein along at least a portion of said opening flap edges from proximal said hinged portion ends towards said locking tabs said opening flap overlaps said top panel.

I. The container according to Paragraph H, wherein said locking tabs are integral with said opening flap.

J. The container according to Paragraph I, wherein between each said locking tab and said free end portion is a slit (170).

K. The container according to any of Paragraphs A to J, wherein said opening flap comprises one or more weakened portions (160) having a weakened portion end (161) or ends oriented towards said locking tabs.

L. The container according to any of Paragraphs F to K, wherein said container body comprises a front panel (180) connected to said top panel, wherein said locking tabs are integral with and extend away from said opening flap edge towards said front panel, wherein said locking tabs have locking tab edges (190) oriented towards said front panel, wherein said locking tab edges are nearer to said front panel than said free end portion seat edge.

M. The container according to Paragraphs F to L:
wherein said locking tabs are separated from one another by a locking tab spacing (LTS);
wherein said opening flap edges are at least partially defined by reverse cuts (200) extending from proximal said hinged portion ends towards said locking tabs; and
wherein at a distance from said locking tabs of more than about 20% of said locking tab spacing said reverse cuts merge.

N. The container according to Paragraph M, wherein said top panel has a top panel interior facing surface (11) oriented towards said interior space; wherein said container body comprises a front panel (180) extending from said free end portion seat and said free end portion seat is in facing relationship with and joined to said top panel interior facing surface; wherein said container body comprises a rear panel (150) connected to said top panel wherein said hinge connects said opening flap to said top panel or said rear panel; and wherein said front panel, said free end portion seat, said top panel, said opening flap, and said rear panel are a one-piece paperboard (3).

O. The container according to Paragraph N, wherein said locking tabs are integral with said opening flap.

P. The container according to Paragraphs F to O, wherein between each said locking tab and said free end portion is a slit (170).

Q. The container according to Paragraphs F to P, wherein said opening flap comprises one or more weakened portions (160) having an end or ends oriented towards said locking tabs.

R. The container according to Paragraph A, wherein said locking tab is integral with said opening flap and said locking tab projects beyond said free end portion seat edge wherein said nonoverlapping relationship is an abutting relationship; wherein at least a portion of said opening flap edges and said panel are separable from one another by a reverse cuts (200); and wherein said opening flap, said panel, and said container body comprise a one-piece paperboard (3).

S. The container according to any of the preceding claims, wherein said container contains dryer sheets comprising a fabric softening active and perfume.

T. The container according to any of the preceding claims, wherein said container contains articles comprising perfume.

U. A container comprising: a top panel (10) having a top panel interior facing surface (11); a free end portion seat (60) in facing relationship with and joined to said top panel interior facing surface, wherein said free end portion seat has a free end portion seat edge (70); a hinge (20); an opening flap (30) connected to said hinge; a locking tab (50) integral with one of said opening flap and said free end portion seat edge; a container body (80) engaged with said top panel, wherein said top panel, said opening flap, and said container body together define an interior space (90), wherein said container body, said free end portion seat, said locking tab, said top panel, and said opening flap are a one-piece paperboard (3); wherein said opening flap comprises; a hinged portion (100) having two hinged portion ends (110); a free end portion (130) in facing relationship with said free end portion seat; wherein said free end portion overlies said free end portion seat edge between two intersection points (140) separated by a separation distance (SD); and two opening flap edges (120) at least partially defined by reverse cuts (200) extending from proximal said hinged portion ends towards said locking tabs, wherein at a distance from said locking tabs of more than about 20% of said separation distance said reverse cuts merge wherein said locking tab is closer to said hinge than said free end portion is to said hinge.

V. A carton blank (4) comprising: a free end portion seat (60) having a free end portion seat edge (70); a front panel (180) extending from and integral with said free end portion seat across a first fold line (220), said free end portion seat between said first fold line and said free end portion seat edge; a bottom panel (230) extending from and integral with said front panel across a second fold line (240); a rear panel (150) extending from and integral with said bottom panel across a third fold line (250); a top panel (10) extending from and integral with said rear panel across a fourth fold line (260); an opening flap (30) connected to said top panel or said rear panel by a hinge (20); wherein said opening flap comprises: a hinged portion (100) having two hinged portion ends (110); two opening flap edges (120) at least partially defined by reverse cuts (200) extending from proximal said hinged portion ends towards free end portion (130) opposing said hinged portion, wherein each opening flap edge has an opening flap edge length (EL) along said opening flap edge between said hinged portion end to said free end portion, wherein said reverse cuts merge at a location more than about 10% of said opening flap edge length away from said free end portion; and one or more locking tabs (50) at a location selected from the group consisting of extending from and integral with said opening flap edge, extending from and integral with said free end portion seat edge, and in the opening flap nearer to said free end portion than a distance orthogonal to said first fold line and between said first fold line and said free end portion seat edge 70.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:
a top panel having a top panel exterior facing surface;
a hinge;
an opening flap connected to said hinge;

two locking tabs connected to one of said opening flap and a free end portion seat having a free end portion seat edge, wherein said free end portion seat is recessed relative to said top panel exterior facing surface; and a container body engaged with said top panel, wherein said top panel, said opening flap, and said container body together define an interior space;

wherein said opening flap comprises:

a hinged portion having two hinged portion ends;

a free end portion in facing relationship with said free end portion seat; and two opening flap edges separable from said top panel, each opening flap edge extending from one of said hinged portion ends to said free end portion;

wherein said free end portion overlies said free end portion seat edge between two intersection points separated by a separation distance;

wherein for each opening flap edge, said opening flap edge is in a nonoverlapping relationship with said top panel from said intersection point to along said opening flap edge to a distance of more than about 20% of said separation distance;

wherein said locking tab is closer to said hinge than said free end portion is to said hinge;

wherein said free end portion is between said locking tabs; and wherein said locking tabs are connected with and extend away from one of said opening flap edge and said free end portion seat edge.

2. The container according to claim 1, wherein said opening flap edges are discontinuous with said top panel and said opening flap and said free end portion seat are operably engaged with one another by said locking tabs.

3. The container according to claim 2 wherein said nonoverlapping relationship is an abutting relationship.

4. The container according to claim 3, wherein said hinge connects said opening flap to said top panel or a rear panel connected to said top panel, said container body further comprising said rear panel.

5. The container according to claim 4, wherein along at least a portion of said opening flap edges from proximal said hinged portion ends towards said locking tab said opening flap overlaps said top panel.

6. The container according to claim 1, wherein said locking tabs are separated from one another by a locking tab spacing and each of said opening flap edges is in a nonoverlapping relationship with said top panel from said locking tabs to along said opening flap edge to a distance of more than about 20% of said locking tab spacing.

7. The container according to claim 6, wherein along at least a portion of said opening flap edges from proximal said hinged portion ends towards said locking tabs said opening flap overlaps said top panel.

8. The container according to claim 7, wherein said locking tabs are integral with said opening flap.

9. The container according to claim 8, wherein between each said locking tab and said free end portion is a slit.

10. The container according to claim 8, wherein said opening flap comprises one or more weakened portions having an end or ends oriented towards said locking tabs.

11. The container according to claim 1, wherein said container body comprises a front panel connected to said top panel, wherein said locking tabs are integral with and extend away from said opening flap edge towards said front panel, wherein said locking tabs have locking tab edges oriented towards said front panel, wherein said locking tab edges are nearer to said front panel than said free end portion seat edge.

12. The container according to claim 1:

wherein said locking tabs are separated from one another by a locking tab spacing;

wherein said opening flap edges are at least partially defined by reverse cuts extending from proximal said hinged portion ends towards said locking tabs; and wherein at a distance from said locking tabs of more than about 20% of said locking tab spacing said reverse cuts merge.

13. The container according to claim 12, wherein said top panel has a top panel interior facing surface oriented towards said interior space;

wherein said container body comprises a front panel extending from said free end portion seat and said free end portion seat is in facing relationship with and joined to said top panel interior facing surface;

wherein said container body comprises a rear panel connected to said top panel wherein said hinge connects said opening flap to said top panel or said rear panel; and wherein said front panel, said free end portion seat, said top panel, said opening flap, and said rear panel are a one-piece paperboard.

14. The container according to claim 13, wherein said locking tabs are integral with said opening flap.

15. The container according to claim 14, wherein between each said locking tab and said free end portion is a slit.

16. The container according to claim 14, wherein said opening flap comprises one or more lines of weakness having an end or ends oriented towards said locking tabs.

17. A container according to claim 1, wherein said locking tabs are integral with said opening flap and said locking tabs project beyond said free end portion seat edge;

wherein said nonoverlapping relationship is an abutting relationship;

wherein at least a portion of said opening flap edges and said panel are separable from one another by a reverse cut structure; and wherein said opening flap, said panel, and said container body comprise a one-piece paperboard.

18. A container comprising:

a top panel having a top panel interior facing surface;

a free end portion seat in facing relationship with and joined to said top panel interior facing surface, wherein said free end portion seat has a free end portion seat edge;

a hinge;

an opening flap connected to said hinge;

two locking tabs integral with one of said opening flap and said free end portion seat edge; and a container body engaged with said top panel, wherein said top panel, said opening flap, and said container body together define an interior space, wherein said container body, said free end portion seat, said locking tab, said top panel, and said opening flap are a one-piece paperboard;

wherein said opening flap comprises:

a hinged portion having two hinged portion ends;

a free end portion in facing relationship with said free end portion seat, wherein said free end portion is between said locking tabs and wherein said free end portion overlies said free end portion seat edge between two intersection points separated by a separation distance; and two opening flap edges at least partially defined by reverse cuts extending from proximal said hinged portion ends towards said locking tabs, wherein at a distance from said locking tabs of more than about 20% of said separation distance said reverse cuts merge;

wherein said locking tabs are closer to said hinge than said free end portion is to said hinge; and wherein said container contains dryer sheets comprising a fabric softening active and perfume.

19. A carton blank comprising:

a free end portion seat having a free end portion seat edge;

a front panel extending from and integral with said free end portion seat across a first fold line, said free end portion seat between said first fold line and said free end portion seat edge;

a bottom panel extending from and integral with said front panel across a second fold line;

a rear panel extending from and integral with said bottom panel across a third fold line;

a top panel extending from and integral with said rear panel across a fourth fold line; and an opening flap connected to said top panel or said rear panel by a hinge;

wherein said opening flap comprises:

a hinged portion having two hinged portion ends;

two opening flap edges at least partially defined by reverse cuts extending from proximal said hinged portion ends towards a free end portion opposing said hinged portion, wherein each opening flap edge has an opening flap edge length along said opening flap edge between said hinged portion end to said free end portion, wherein said reverse cuts merge at a location more than about 10% of said opening flap edge length away from said free end portion; and two locking tabs at a location selected from the group consisting of extending from and integral with the opening flap edge, extending from and integral with the free end portion seat edge, and in the opening flap nearer to said free end portion than a distance orthogonal to said first fold line and between said first fold line and said free end portion seat edge.

* * * * *